US009581324B2

(12) United States Patent
Zhai et al.

(10) Patent No.: US 9,581,324 B2
(45) Date of Patent: Feb. 28, 2017

(54) LED ILLUMINATION DEVICE HAVING A HEAT SINK WITH A PLURALITY OF SETS OF FINS DEFINING AIR TUNNELS OF DIFFERENT SIZES

(71) Applicants: CHAMP TECH OPTICAL (FOSHAN) CORPORATION, Foshan (CN); Foxconn Technology Co., Ltd., New Taipei (TW)

(72) Inventors: Ming-Hui Zhai, Foshan (CN); Wen Xu, Foshan (CN); Shih-Hsun Wung, New Taipei (TW)

(73) Assignees: CHAMP TECH OPTICAL (FOSHAN) CORPORATION, Foshan (CN); Foxconn Technology Co., Ltd., New Taipei (TW)

( * ) Notice: Subject to any disclaimer, the term of this patent is extended or adjusted under 35 U.S.C. 154(b) by 83 days.

(21) Appl. No.: 14/614,595

(22) Filed: Feb. 5, 2015

(65) Prior Publication Data

US 2016/0215969 A1 Jul. 28, 2016

(30) Foreign Application Priority Data

Jan. 22, 2015 (CN) ..... 2015 1 0030363

(51) Int. Cl.

| | |
|---|---|
| ***F21V 29/83*** | (2015.01) |
| ***F21V 21/08*** | (2006.01) |
| ***F21V 23/00*** | (2015.01) |
| ***F21V 23/02*** | (2006.01) |
| ***F21V 29/75*** | (2015.01) |

(Continued)

(52) U.S. Cl.

CPC ..... *F21V 29/83* (2015.01); *F21V 21/08* (2013.01); *F21V 23/008* (2013.01); *F21V 23/023* (2013.01); *F21V 29/75* (2015.01); *F21V 29/773* (2015.01); *F21V 29/507* (2015.01);

(Continued)

(58) Field of Classification Search

CPC ..... F21V 29/74; F21V 29/83; F21V 29/78; F21V 29/70; F21V 29/71; F21V 29/713; F21V 29/717; F21V 29/73; F21V 29/745; F21V 29/75; F21V 29/76; F21V 29/763;

(Continued)

(56) References Cited

U.S. PATENT DOCUMENTS 4,715,438 A * 12/1987 Gabuzda ..... H01L 23/3672 165/185
8,322,897 B2 * 12/2012 Blincoe ..... F21V 29/004 362/294

(Continued)

FOREIGN PATENT DOCUMENTS

WO WO 2014027755 A1 * 2/2014 ..... F21V 29/75

*Primary Examiner* — Robert May
(74) *Attorney, Agent, or Firm* — Zhigang Ma

(57) ABSTRACT

An LED illumination includes a heat sink, and an LED module mounted on the heat sink. The heat sink includes a base, a receiving tube extending upwardly from a first face of the base, and a plurality of fins arranged on the first face of the base and surrounding the receiving tube. The plurality of fins extends radially and outwardly beyond an outer periphery of the base in relation to the receiving tube. A band engages and encloses the plurality of fins. A plurality of air tunnels are defined between the base, the band and the plurality of fins. The LED module is mounted on a second face of the base opposite to the first face.

20 Claims, 5 Drawing Sheets

(51) Int. Cl.
*F21V 29/77* (2015.01)
*F21V 29/507* (2015.01)
*F21V 29/508* (2015.01)

(52) U.S. Cl.
CPC ..... *F21V 29/508* (2015.01); *F21Y 2105/18* (2016.08); *F21Y 2115/10* (2016.08)

(58) Field of Classification Search
CPC ..... F21V 29/767; F21V 29/77; F21V 29/773; F21V 29/777; F21Y 2101/02
See application file for complete search history.

(56) References Cited

U.S. PATENT DOCUMENTS 8,801,222 B2 * 8/2014 Wung ..... F21V 29/2206 362/249.02
2013/0223083 A1 * 8/2013 Kimiya ..... F21V 29/2206 362/382

* cited by examiner

LED ILLUMINATION DEVICE HAVING A HEAT SINK WITH A PLURALITY OF SETS OF FINS DEFINING AIR TUNNELS OF DIFFERENT SIZES

FIELD

The subject matter herein generally relates to an LED (light emitting diode) illumination device, and more particularly relates to an improved LED illumination device with high heat dissipation efficiency.

BACKGROUND

A traditional LED illumination device generally includes multiple LEDs in order to achieve the required intensity of light. Since the traditional LED illumination device may lack effective heat dissipation mechanisms, heat accumulated during operation may not be rapidly dissipated, resulting in flickering or even malfunction of the LEDs.

BRIEF DESCRIPTION OF THE DRAWINGS

Implementations of the present technology will now be described, by way of example only, with reference to the attached figures.

DETAILED DESCRIPTION

Figure 1:
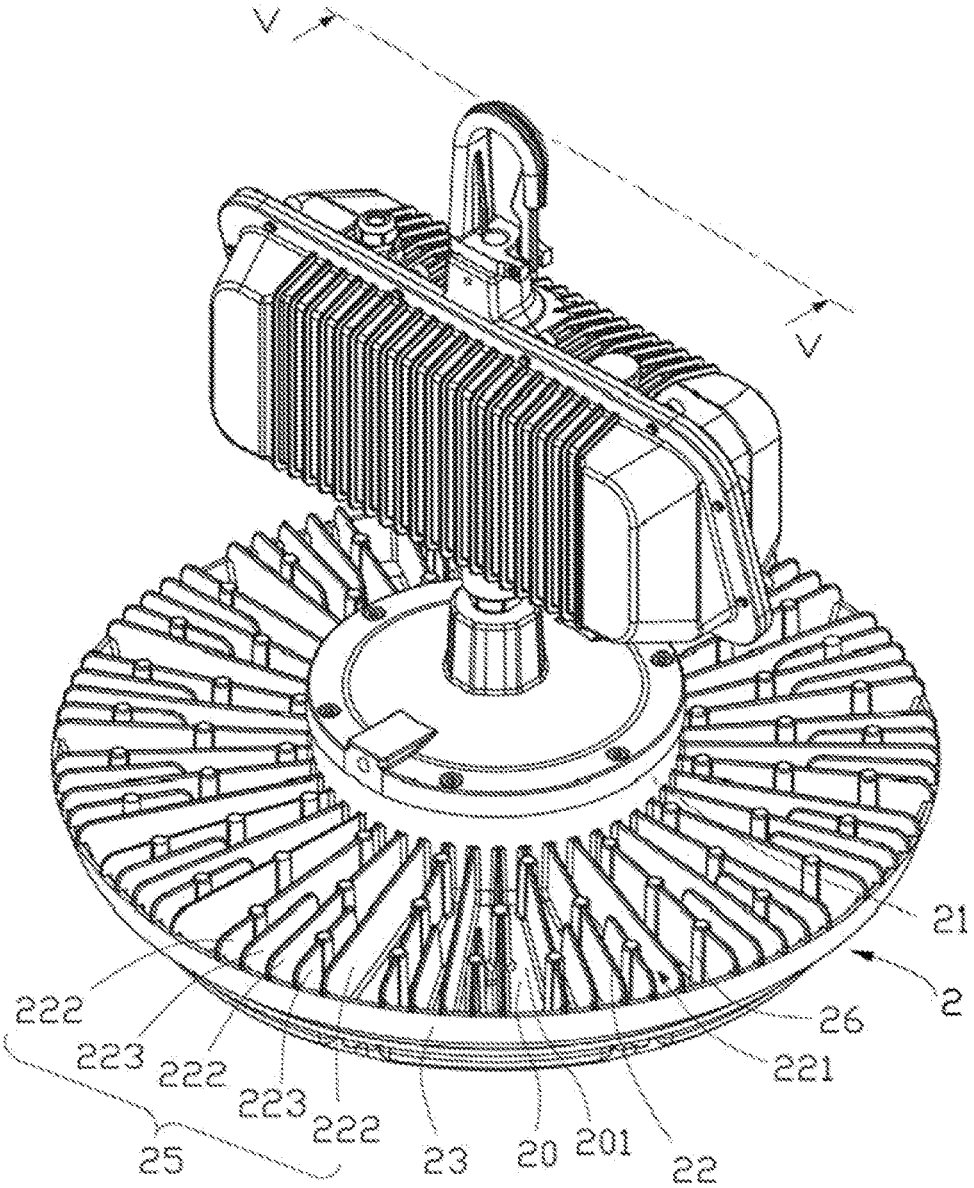
FIG. 1 is an isometric, assembled view of an LED illumination device according to an exemplary embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an LED illumination device, and more particularly relates to an improved LED illumination device with high heat dissipation efficiency.

Figure 5:
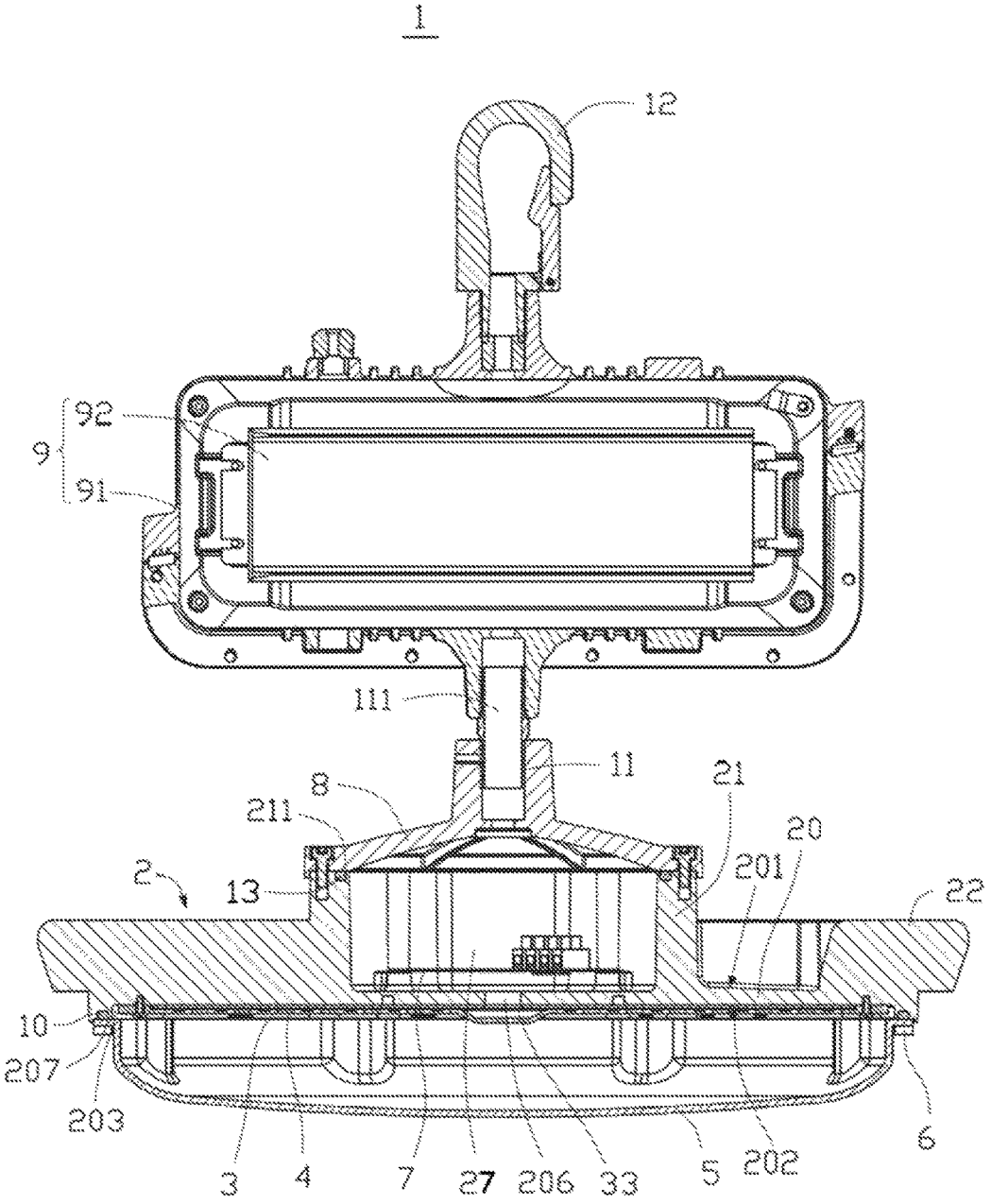
FIG. 5 is a cross-sectional view of the LED illumination device of FIG. 1, taken along line V-V thereof.

Referring to FIG. 5, an LED illumination device 1 in accordance with an exemplary embodiment of the disclosure is illustrated. The LED illumination device 1 includes a heat sink 2 having a receiving tube 21, an LED module 3 thermally attached to a bottom face of the heat sink 2, a light-guiding member 4 coupled to the LED module 3, a lampshade 5 engaging the heat sink 2 to cover the LED module 3 and the light-guiding member 4, a pressing frame 6 securing the lampshade 5 to the heat sink 2, a wire arranger 7 received in the receiving tube 21 of the heat sink 2, a cap 8 engaging an upper end of the receiving tube 21, a driving module 9 spaced apart from the heat sink 2, a connecting member 11 connecting the driving module 9 to the cap 8, and a hook 12 on the driving module 9.

The heat sink 2 is integrally made of metal with good heat conductivity such as aluminum, copper or an alloy thereof. The heat sink 2 further includes a circular base 20 and a plurality of fins 22 arranged on a first face 201 of the base 20. The receiving tube 21 extends upwardly from the first face 201 of the base 20. The fins 22 surround the receiving tube 21.

The LED module 3 is thermally attached to a second face 202 of the base 20 opposite to the first face 201.

Figure 2:
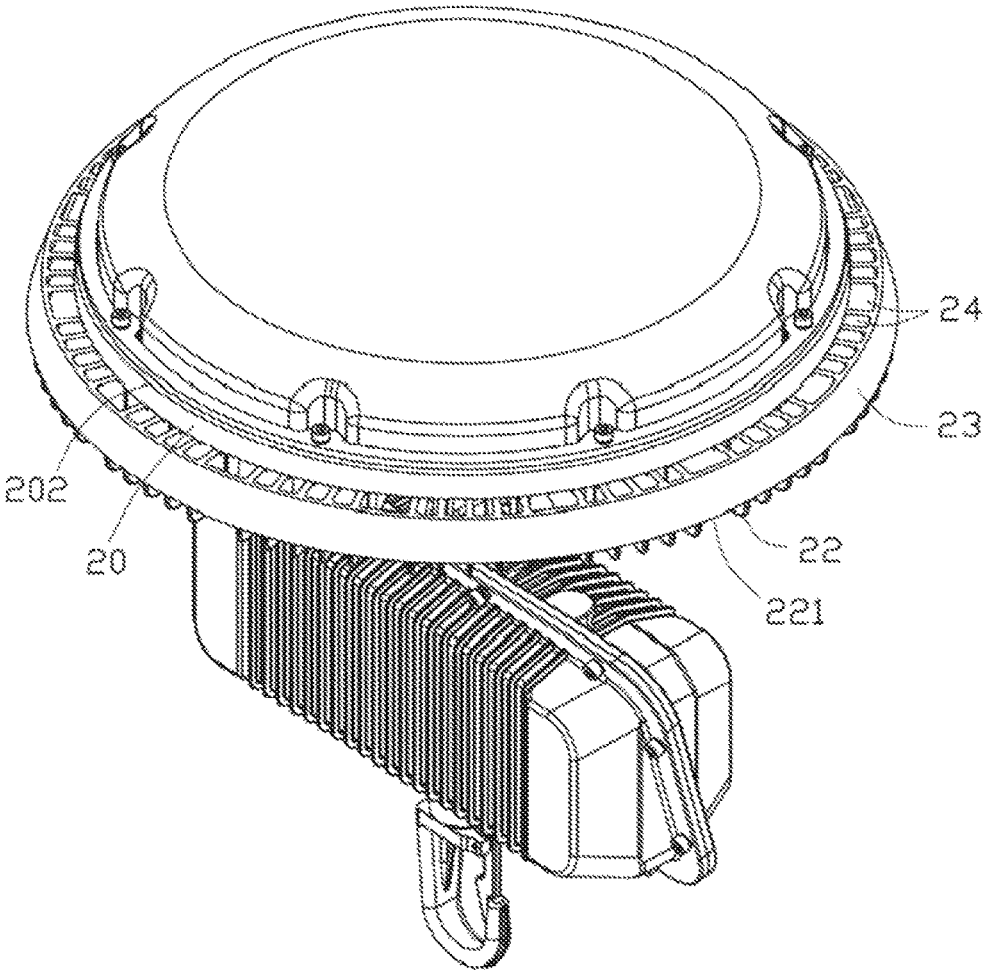
FIG. 2 is similar to FIG. 1, but showing the LED illumination device from another angle.

Referring to FIGS. 1 and 2, the plurality of fins 22 extend radially and outwardly beyond an outer periphery of the base 20 in relation to the receiving tube 21. The plurality of fins 22 are spaced from each other. An airflow passage 221 is defined between every two adjacent fins 22.

A band 23 encloses and engages the plurality of fins 22. Specifically, an outermost edge of each fin 22 is engaged with and enclosed by the band 23.

A plurality of air tunnels 24 are defined between the base 20, the band 23 and the plurality of fins 22. The plurality of air tunnels 24 are spaced from each other and arranged along an outer circumference of base 20. Each air tunnel 24 is aligned with and directly communicated with a corresponding airflow passage 221. The air tunnels 24 each expand from the second face 202 to the first face 201 of the base 20 (i.e., a bottom-to-top direction, as viewed from FIG. 1).

The plurality of the fins 22 can be different in length. Specifically, the plurality of fins 22 include a plurality of first fins 222 having a relatively long length and a plurality of second fins 223 having a relatively short length. Preferably, the length of each second fin 223 is about half the length of each first fin 222. However, it is understood that the length ratio between the first fins 222 and the second fins 223 is not limited thereto, and can be adjusted according to the actual requirements.

The plurality of fins 22 have substantially the same height. A plurality of reinforcing ribs 26 are provided to maximize a strength and rigidity of the fins 22. The ribs 26 protrude upwardly from the first face 201 of the base 20. Each rib 26 is cylindrical and connects a corresponding one of the fins 22 onto the first face 201 of the base 20.

The plurality of fins 22 partially extend from an outer circumference of the receiving tube 21. Specifically, each first fin 222 extends radially and outwardly from the outer circumference of the receiving tube 21, while each second fin 223 extends radially and outwardly from a central region of the first face 201 of the base 20 apart from the receiving tube 21. Accordingly, two adjacent airflow passages 221 which are defined by two spaced first fins 222 and a second fin 223 interposed between the two spaced first fins 22 communicate at their inner ends.

The plurality of fins 22 can be divided into many separate sets of fins 25. Each set of fins 25 includes three spaced first fins 222 and two spaced second fins 223 with each second fin 223 being interposed between every two adjacent first fins 222.

The air tunnels 24 within each set of fins 25 and the air tunnels 24 between every two adjacent sets of fins 25 are different in size. Specifically, the size of each air tunnel 24 within each set of fins 25 is smaller than the size of each air tunnel 24 between every two adjacent sets of fins 25. Preferably, the size of each air tunnel 24 within each set of fins 25 is half the size of each air tunnel 24 between every two adjacent sets of fins 25. However, it is understood that the size ratio between the air tunnels 24 within each set of fins 25 and the air tunnel 24 between every two adjacent sets of fins 25 is not limited thereto, and can be adjusted according to the actual requirements.

Figure 3:
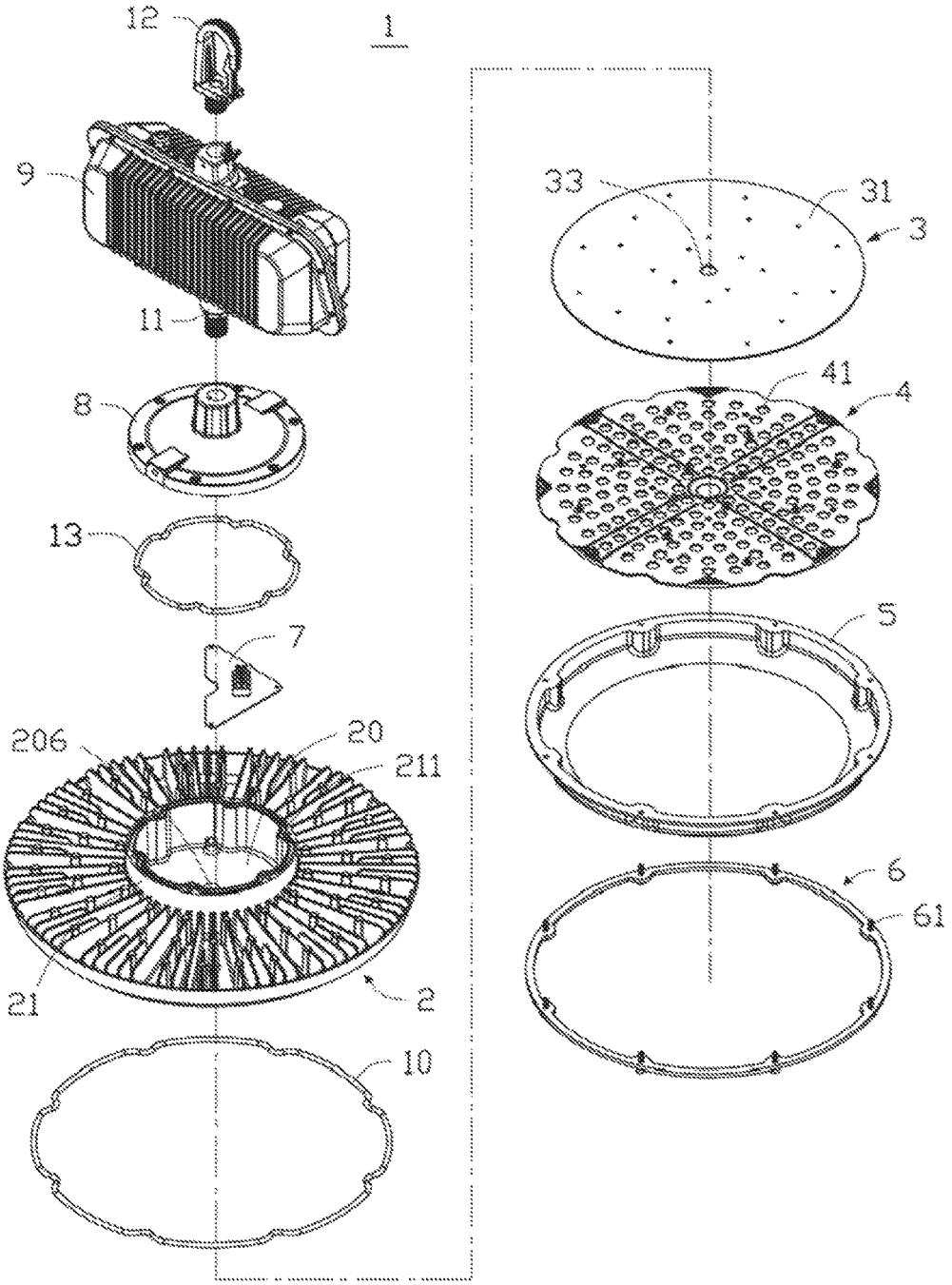
FIG. 3 is an exploded view the LED illumination device of FIG. 1.
Figure 4:
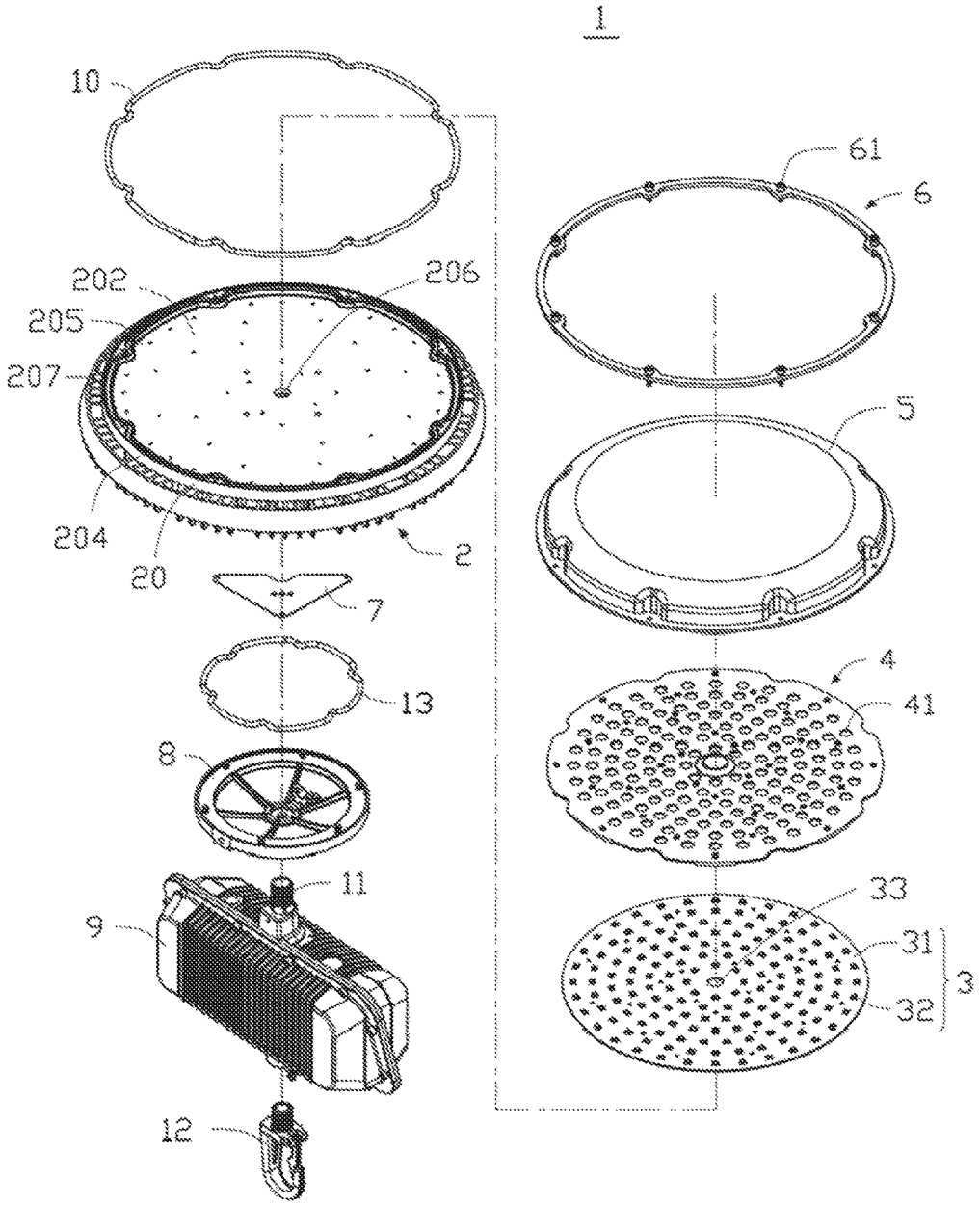
FIG. 4 is an exploded view the LED illumination device of FIG. 2.

Referring to FIGS. 3 and 4, the second face 202 is depressed at the center towards the inside of the heat sink 2, whereby an annular mounting portion 204 is formed along an outer periphery of the second face 202 of the base 20, and a circular receiving portion 205 is defined at the central area of the base 20 and surrounded by the mounting portion 204. The LED module 3 is correspondingly mounted on the receiving portion 205. A through hole 206 is defined in the center of the receiving portion 205 of the base 20 for insertion of electrical wires (not shown). The annular mounting portion 204 also defines a first waterproof groove 207 for accommodating a first sealant 10 such as an adhesive tape.

The upper end of the receiving tube 21 defines a second waterproof groove 211 for accommodating a second sealant 13 such as an adhesive tape.

The LED module 3 comprises a circular printed circuit board 31 and a plurality of LEDs 32 mounted on the printed circuit board 31. The printed circuit board 31 is attached to the receiving portion 205 of the heat sink 2 and thermally connects therewith, whereby heat generated by the LEDs 32 can be effectively absorbed by the heat sink 2. The LEDs 32 are arranged in matrix on the printed circuit board 31 and spaced from each other. A penetrating hole 33 is defined in the center of the printed circuit board 31 and aligned with the through hole 206 of the base 20.

The light-guiding member 4 defines a plurality of tapered cavities 41 through which the LEDs 32 of the LED module 3 are inserted. When the LEDs 32 are activated, a part of light emitted from the LEDs 32 is able to emit to the outside directly without reflection, and the remaining part of the light is first reflected by inner faces of the cavities 31 and then emits to the outside. In other words, the light-guiding member 4 functions as a secondary optical element for the LEDs 32.

The lampshade 5 is integrally formed of a transparent or semitransparent material such as glass, resin or plastic. The lampshade 5 is designed in the shape of a shallow disk and depressed at the center along a direction away from the heat sink 2.

The pressing frame 6 is annular and has a diameter substantially equal to that of the lampshade 5. Eight fasteners 61 are provided at equal-angular intervals around the circumference of the pressing frame 6 to secure the lampshade 5 onto the heat sink 2. The lampshade 5 is hermetically connected to the base 20 of the heat sink 2 with an outer periphery of the lampshade 5 engaging the mounting portion 204 of the base 20. In the present embodiment, the fasteners 61 are screws and bolts.

The cap 8 is hermetically connected to the receiving tube 21 of the heat sink 2 to define a chamber 27 (see FIG. 5) for accommodating the wire arranger 7.

Referring to FIG. 5 also, the driving module 9 is spaced apart from the heat sink 2 by a predetermined distance to increase heat insulation between the driving module 9 and the heat sink 2. In the present embodiment, the driving module 9 includes a power supply box 91 and a power adapter 92 accommodated in the power supply box 91.

The driving module 9 is connected to the heat sink 2 via a connecting member 11. Specifically, the connecting member 11 interconnects the driving module 9 and the cap 8 which is hermetically connected to the receiving tube 21 of the heat sink 2. Preferably, the connecting member 11 is a screwed conduit having screw threads formed thereon for facilitating connection between the driving module 9 and the heat sink 2. The connecting member 11 also defines a channel 111 therein through which electrical wires extend.

Electrical wires (not shown) can sequentially pass through the connecting member 11, the cap 8, the receiving tube 11, the through hole 206 of the base 20, and the penetrating hole 33 of the LED module 3 to make an electrical connection between the LED module 3 and the driving module 9. Preferably, electrical wires extending between the LED module 3 and the driving module 9 are arranged by the wire arranger 7 accommodated in the chamber 26.

When the LED illumination device 1 is assembled, the first sealant 10 disposed in the first waterproof groove 207 hermetically seals the lampshade 5 to the heat sink 2, and the second sealant 13 disposed in the second waterproof groove 211 hermetically seals the cap 8 to the heat sink 2. Accordingly, moisture air or dust is prevented from penetrating into the inside of the LED illumination device 1.

The hook 12 is screwed onto the top of the driving module 9. In use, the LED illumination device 1 can be fixed to a wall or a ceiling via the hook 12. Alternatively, a hinge can be applied together with the hook 12 to firmly secure the LED illumination device 1 onto the wall or the ceiling.

When the LED module 3 is activated, light generated by the LED module 3 can radiate downwardly through the light guide member 4 and the lampshade 5 to illuminate an intended object.

During operation, heat generated by the LEDs 32 is absorbed by the heat sink 2, and then the heat is dissipated into ambient air via the fins 22. The air tunnels 24 communicate the second face 202 of the base 20, the first face 201 of the base 20 and the airflow passage 221 between adjacent fins 22, whereby the heat generated by the LEDs 32 can be more easily dissipated to the outside, whereby the LED illumination device 1 with high heat dissipation efficiency is achieved.

The embodiments shown and described above are only examples. Many details are often found in the art such as the other features of an LED illumination device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An LED illumination device comprising:

a heat sink comprising a base, a receiving tube extending upwardly from a first face of the base, and a plurality of fins arranged on the first face of the base and surrounding the receiving tube;

an LED module mounted on a second face of the base opposite to the first face; and a band which engages and encloses the plurality of fins;

wherein the plurality of fins extend radially and outwardly beyond an outer periphery of the base in relation to the receiving tube, and a plurality of air tunnels are defined between the base, the band and the plurality of fins; and wherein the plurality of fins comprises sets of fins, and each set of fins comprises three spaced first fins and two spaced second fins with each second fin being interposed between every two adjacent first fins, wherein the air tunnels within each set of fins and the air tunnels between every two adjacent sets of fins are different in size.

2. The LED illumination device as described in claim 1, wherein the plurality of fins are spaced from each other, and an airflow passage is defined between every two adjacent fins.

3. The LED illumination device as described in claim 2, wherein each air tunnel is aligned with and directly communicated with a corresponding airflow passage.

4. The LED illumination device as described in claim 3, wherein the air tunnels are spaced from each other.

5. The LED illumination device as described in claim 1, wherein the plurality of the fins are different in length.

6. The LED illumination device as described in claim 5, wherein the plurality of the fins comprises a plurality of first fins having a relatively long length and a plurality of second fins having a relatively short length.

7. The LED illumination device as described in claim 6, wherein each first fin extends radially and outwardly from an outer circumference of the receiving tube, and each second fin extends radially and outwardly from a central region of the first face of the base apart from the receiving tube.

8. The LED illumination device as described in claim 1, wherein the size of each air tunnel within each set of fins is smaller than the size of each air tunnel between every two adjacent sets of fins.

9. The LED illumination device as described in claim 1, wherein the air tunnels each expand from the second face to the first face of the base.

10. The LED illumination device as described in claim 1, wherein the plurality of fins have substantially the same height.

11. The LED illumination device as described in claim 1, further comprising a light-guiding member engaged with the LED module, and the light-guiding member defines a plurality of tapered cavities for insertion of multiple LEDs included in the LED module.

12. The LED illumination device as described in claim 1, further comprising a lampshade engaging the heat sink.

13. The LED illumination device as described in claim 1, further comprising a cap hermetically connected to an upper end of the receiving tube, wherein the cap and the receiving tube cooperatively define a chamber.

14. The LED illumination device as described in claim 1, further comprising a driving module spaced apart from the heat sink by a predetermined distance.

15. The LED illumination device as described in claim 14, wherein the driving module comprises a power supply box and a power adapter accommodated in the power supply box, and the power supply box is connected to the heat sink via a connecting member.

16. The LED illumination device as described in 15, wherein the base defines a through hole extending through the base from the first face to the second face, and electrical wires sequentially pass through the connecting member having a channel, the tube, and the through hole of the base to make an electrical connection between the LED module and the driving module.

17. The LED illumination device as described in claim 1, wherein the device further comprises a first sealant, and the base comprises an annular mounting portion along an outer periphery of the second face, and the annular mounting portion defines a first waterproof groove, and the first sealant is received in the first waterproof groove.

18. The LED illumination device as described in claim 1, wherein the device further comprises a wire arranger received in the receiving tube of the heat sink, and electrical wires extending between the LED module and the driving module are arranged by the wire arranger accommodated in the chamber.

19. The LED illumination device as described in claim 1, wherein the device further comprises a second sealant, and the upper end of the receiving tube defines a second waterproof groove for accommodating the second sealant.

20. An LED illumination device comprising:

a heat sink comprising a base, a receiving tube extending upwardly from a first face of the base, and a plurality of fins arranged on the first face of the base and surrounding the receiving tube;

an LED module mounted on a second face of the base opposite to the first face;

a band which engages and encloses the plurality of fins; and a driving module electrically connected to the LED module;

wherein the driving module is spaced apart from the heat sink by a predetermined distance to increase heat insulation between the driving module and the heat sink, and wherein the plurality of fins extends radially and outwardly beyond an outer periphery of the base in relation to the receiving tube, and a plurality of air tunnels are defined between the base, the band, and the plurality of fins;

and wherein the plurality of fins comprises sets of fins, and each set of fins comprises three spaced first fins and two spaced second fins with each second fin being interposed between every two adjacent first fins, wherein the air tunnels within each set of fins and the air tunnels between every two adjacent sets of fins are different in size.

* * * * *